United States Patent [19]

Honaker et al.

[11] 4,092,098

[45] May 30, 1978

[54] METHOD AND APPARATUS FOR IMPROVED IN SITU COMBUSTION OF PYROLYSIS GASES IN A KILN

[75] Inventors: Donald E. Honaker, Ballwin; Louis J. Jacobs, Jr., Des Peres, both of Mo.

[73] Assignee: Monsanto Company, St. Louis, Mo.

[21] Appl. No.: 737,745

[22] Filed: Nov. 1, 1976

[51] Int. Cl.[2] ..... F27D 7/00

[52] U.S. Cl. ..... 432/19; 110/246; 201/32; 202/100; 432/105; 432/109

[58] Field of Search ..... 432/19, 105, 109, 111; 110/14; 201/32; 202/100

[56] References Cited

U.S. PATENT DOCUMENTS

| | | | |
|---|---|---|---|
| 997,381 | 7/1911 | Fasting | 110/14 X |
| 1,800,247 | 4/1931 | Buckbee | 110/14 X |
| 1,929,880 | 10/1933 | Darrah | 110/14 |
| 3,542,348 | 11/1970 | Jahn et al. | 432/105 |

FOREIGN PATENT DOCUMENTS

| | | | |
|---|---|---|---|
| 11,942/33 | 3/1933 | Australia | 110/14 |

OTHER PUBLICATIONS

"Some Details of the Structure of an Axissymmetric Confined Jet with Back Flow" by Barchilon and Curtet, Journal of Basic Engineering/Transactions of the ASME, June 1971, pp. 192–198.

Proceedings of the Ninth Symposium (International) on Combustion held at Cornell University, Ithaca, N.Y. Aug. 27–Sept. 1, 1962, Pubished 1963 in Academic Press: (a) "Mixing and Flow in Duoted Turbulent Jets" by Becker, Hottel and Williams, pp. 7–20 and (b) "Modeling of Double Concentric Burning Jets" by Beer, Chigier, and Lee, pp. 892–900.

*Primary Examiner*—John J. Camby

*Attorney, Agent, or Firm*—Arthur E. Hoffman

[57] ABSTRACT

Temperature control is often a problem in direct-fired rotary kilns for the pyrolysis of carbonaceous materials wherein at least part of the thermal energy for pyrolysis is obtained by in situ combustion of the pyrolysis gases. The present process and apparatus provides a means by which temperature control, and particularly reduction in intensity of the fireball at the burner end of the kiln and/or moving the fireball away from the burner hood. This is accomplished by (1) controlling the velocity of any burner gases and the velocity of the in situ air (or other oxygen-containing gas) and (2) the distribution of the in situ air at the burner end of the kiln, such that a Craya-Curtet number of at least 0.2, and preferably at least 0.4, is obtained. In a preferred embodiment, the in situ air is admitted into the burner hood from a plenum chamber disclosed circumferentially around at least a portion of the kiln, the air entering the burner hood through the annulus defined between the outer shell of the kiln and the burner hood.

11 Claims, 5 Drawing Figures

METHOD AND APPARATUS FOR IMPROVED IN SITU COMBUSTION OF PYROLYSIS GASES IN A KILN

BACKGROUND OF THE INVENTION

This invention relates to an improved method and apparatus for the pyrolysis of carbonaceous materials in a rotary kiln wherein at least a portion of the thermal energy required for pyrolysis is provided by the in situ combustion of at least a portion of the pyrolysis gases. More particularly, it relates to an improved method and apparatus for supplying and distributing an oxygen-containing gas at the burner end of a direct-fired rotary kiln for the support of such in situ combustion of the pyrolysis gases.

DESCRIPTION OF THE PRIOR ART

Pyrolysis of carbonaceous materials in direct-fired rotary kilns is well-known, as is the in situ combustion of at least a portion of the pyrolysis gases evolved so as to provide some or all of the thermal energy required to support the endothermic pyrolysis reactions. In order to minimize or avoid incineration (i.e., oxidative combustion) of the carbonaceous material, controlled quantities of air, oxygen or other oxygen-containing gas are necessarily admitted to the kiln in order to accomplish the desired in situ combustion of the pyrolysis gases.

Various methods and apparatus have been taught by means of which the desired quantities of air (air is used for discussion purposes) are admitted in order to provide the desired degree of in situ combustion as well as to provide a desired temperature profile throughout the length of the kiln.

Generally, the prior art teaches the addition of air through tuyeres at predetermined points along the length of the kiln at some distance away from both the burner end and the feed end of the kiln. Such points of air injection usually being chosen to approximately coincide with points of desired temperature maximums in the temperature profile in the kiln. Kiln temperature control and exact control of the temperature profile (i.e., points of maximum temperatures) are then obtained by regulating the rate of air supply or the feed rate of the carbonaceous material, or both. Exemplary of such processes are U.S. Pat. Nos. 3,966,560; 3,888,621; and 2,813,822.

Processes and apparatus are also known where most or all of the air required for the desired in situ combustion is admitted to the kiln at the burner end of the kiln. Insofar as is known, the in situ combustion air is admitted in such processes and apparatus through the burner nozzle(s) plus one or more air nozzles disposed in or near the burner hood. Typically the burner operates with a considerable excess of air over that necessary for combustion of the burner fuel, the excess air being available for in situ combustion of the pyrolysis gases. Even if the burner flame is discontinued, the air supply to the burner is continued at least to the extent necessary to prevent thermal damage to the burner nozzle.

It has been found that when the in situ air is injected in this way into a zone where the expanding combustion products from the burner flame have not as yet expanded to reach the kiln walls, the jets of air and the jet of burner gases cause eddy currents or re-circulation of burner gases, air and pyrolysis gases resulting in a fireball either within the burner hood or just inside the kiln at the burner end. This fireball results in excessive temperature rise at the burner end of the kiln and poor control over the temperature profile. This excessive temperature can also result in kiln damage either to refractory or to the steel shell because of thermal expansion and stress.

The same phenomena occurs even if the burner flame is discontinued since the air jet from the burner nozzle and from other air nozzles have an aspirating effect which causes recirculation of pyrolysis gases and air.

It is therefore necessary to either eliminate the fireball, decrease its heat intensity, or move it down the kiln to some point remote from the burner end where a controllable temperature maximum in the temperature profile is desired. None of the known prior art teaches how this may be accomplished in a pyrolysis reaction where controlled in situ combustion of the pyrolysis gases is desired using in situ combustion air admitted at or near the burner.

The processes and apparatus discussed above where the air is admitted at locations remote from the burner end provide no solution since they admit the air at locations in the kiln where the combustion gases from the burner have already expanded to the kiln walls and thus the recirculation phenomena observed when the air is admitted at the burner end is not present. Moreover such art suggests that the location of a temperature maximum can only be controlled by adjusting either or both the rate of air supply or the carbonaceous material feed rate so as to change the proportion of pyrolysis gases which are in situ combusted; which is not always desired or feasible. Reducing the feed rate of the carbonaceous material reduces the production capacity of the process and the kiln. Changing the rate of in situ air supply is not feasible where complete in situ combustion of the pyrolysis gases is desired, and is disadvantageous even when only partial in situ combustion is desired but the remaining BTU (or caloric) value of the pyrolysis gases are to be burned in a separate afterburner or furnance for resource recovery such as the generation of steam since significant variations in the fuel value of the kiln off-gases would upset the operation of the resource recovery operation.

SUMMARY OF THE INVENTION

It is an object of this invention to provide a process and apparatus for the pyrolysis of carbonaceous materials in a direct-fired rotary kiln wherein at least a portion of the pyrolysis gases are combusted in situ with an oxygen-containing gas admitted at the burner end of the kiln without undue recirculation at the burner end of pyrolysis gases and oxygen-containing gas.

It is a further object of this invention to provide a method and apparatus for pyrolysis of carbonaceous material, whereby improved temperature control is obtained in a direct-fired rotary kiln wherein at least a portion of the pyrolysis gases are combusted in situ with an oxygen-containing gas admitted at the burner end of the kiln.

These and other objects are attained by a process and apparatus employing such process which comprises pyrolyzing a carbonaceous material in a direct-fired rotary kiln with at least a portion of the thermal energy required for pyrolysis being obtained by the in situ combustion of at least a portion of the pyrolysis gases generated within the kiln with controlled quantities of an oxygen containing gas admitted at the burner end of the kiln, said carbonaceous material undergoing pyrolysis being fed into the kiln at one end of the kiln and flowing toward the burner end of the kiln counter-current to the flow of the gaseous matter in the kiln, controlling the velocity of any gases (i.e., combusting burner gases and/or in situ air) from the burner and the velocity of the oxygen-containing gas within the burner end of the kiln and distributing said oxygen-containing gas over a sufficiently large proportion of the internal radial cross-sectional area of said burner end of the kiln, so as to obtain a Craya-Curtet number of at least 0.2.

The term "carbonaceous material" as used herein is intended to refer to any heat decomposable organic material such as wood or other vegetable matter, coal, petroleum coke, dewatered sewage sludges, municipal waste, etc. In a preferred embodiment of this invention municipal waste such as found in city dumps or landfills is the source of the carbonaceous material. Such municipal waste may be derived from household, commercial and/or industrial trash and garbage. It will be understood that the carbonaceous material need not be separated from the metal, glass, etc., components of the municipal waste in order to be processed in accordance with this invention.

The term "oxygen-containing gas" as used herein is intended to refer to oxygen itself, air, oxygen enriched air or any gas in which oxygen is a significant component. In a preferred embodiment of this invention, air is used because of its ready availability. The subsequent discussion of this invention will be in terms of air but it is to be understood that such teaching is applicable to the other oxygen-containing gases as well.

The term "Craya-Curtet number" is a measurement of the aerodynamic flow pattern of a confined, turbulent jet. A full teaching of the determination of the Craya-Curtet number in a cylindrical body such as a rotary kiln can be found in a paper by H. A. Becker, H. C. Hottel and G. C. Williams entitled "Mixing and Flow in Confined Turbulent Jets" in the proceedings of the "Ninth Symposium (International) on Combustion" held at Cornell University at Ithaca, N.Y. from Aug. 27 to Sept. 1, 1962, organized by The Combustion Institute and published in 1963 by the Academic Press, pages 7–20 (which is hereby incorporated into and made a part of this patent specification by reference).

It has been found that when the air required for the desired degree of in situ combustion of the pyrolysis gases is admitted at the burner end of the kiln at a velocity and distributed over a sufficient proportion of the internal radial cross-sectional area of the kiln at the burner end such that the Craya-Curtet number is at least 0.2, preferably at least 0.4, and more preferably at least 0.7, recirculation of the pyrolysis gases and air back into the burner hood or the nose of the kiln at the burner hood is greatly reduced or even eliminated as a significant factor, and that the fireball, now greatly reduced in intensity, is moved down the length of the kiln to a point remote from the burner end. When the burner is in operation it is also necessary to take the effect of the velocity of the combusting burner gases into consideration in determining the air velocity and distribution necessary to obtain the desired Craya-Curtet number. Even when the burner flame is discontinued, the air supply thereto is often continued as a source of in situ air as well as to cool the burner nozzle and prevent thermal damage to the burner nozzle. In such event it is also necessary to take into consideration the velocity of the air stream from the burner nozzle.

With a Craya-Curtet number of about 0.2, the fireball is moved out of the burner hood or the end of the kiln at the burner end to a point down the longitudinal axis of the kiln about 0.8 to 1 kiln diameter from the burner nozzle. However, the heat intensity of the fireball is not reduced to any great degree. This is considered the minimum necessary to the practice of this invention and to obtain the benefits thereof.

At a Craya-Curtet number of about 0.4, the fireball is moved down the kiln about 1.5 times the kiln diameter and recirculation is decreased such that the heat intensity of the fireball is substantially decreased. Substantial benefits are obtained from the practice of this invention when the Craya-Curtet number is at least 0.4, which forms a preferred embodiment of this invention.

In a particularly preferred embodiment, at a Craya-Curtet number of about 0.7, the gaseous flow at the burner end of the kiln approaches a plug flow pattern within the kiln, the fireball is moved down the kiln by up to 2.5 kiln diameters from the burner nozzle and the heat intensity of the fireball is markedly further decreased.

When pyrolyzing carbonaceous materials in a rotary kiln with in situ combustion of the pyrolysis gases, it is normally desired to maintain the oxidizing atmosphere of the combusting pyrolysis gases above the bed of pyrolyzing carbonaceous material so as to minimize as much as possible exposure of the carbonaceous material to this oxidizing atmosphere which would result in partial incineration rather than pyrolysis of the carbonaceous material exposed to such oxidizing environment.

Thus, while ideally the in situ air would be uniformly distributed over the entire radial internal cross-sectional area of the rotary kiln at the burner end thereof, as a practical matter the probability of incinerating carbonaceous material plus entrainment caused by in situ air flowing through the solid residue spilling out of the kiln from the burner end thereof, makes it most desirable to admit the in situ air such that it is distributed essentially above the bed of pyrolyzing material or residue within the kiln at the burner end so as to obtain the desired Craya-Curtet number.

Various means may be used to so distribute the in situ air such as, for example, by means of a plenum chamber surrounding the burner such that air can be blown from the plenum chamber through the steel shell and refractory lining of the burner hood which are fabricated to be suitably foraminous so as to provide a large number of openings communicating with the plenum chamber through which air can be admitted over a large cross-sectional area corresponding to the interior radial cross-sectional area of the burner end of the kiln above the bed of solid residue at said end.

Similarly, in situ air can be delivered into the burner hood from an air header pipe circumventing the burner hood with a plurality of air conduits from the header extending through the refractory wall of the burner hood, as shown in FIG. 5.

Another and especially preferred means of practicing this invention is through provision of a plenum chamber around the circumference of the kiln at the burner end as shown in FIGS. 1 and 2 whereby air is forced through the annular space defined between the outer shell of the kiln and the burner hood, into the burner hood. It will be noted that all of the air being admitted is initially flowing toward the back wall of the burner hood. It has been found that air admitted in this way becomes rather well distributed by means of the aspirating affect of the expanding burner gases (or of the in situ air from the burner nozzle when the flame is discontinued) and/or combusting pyrolysis gases within the kiln as well as by impact upon and scattered reflectance back from the rear wall of the burner. In any event the air distribution obtained practicing this embodiment provides substantially the same results as predicted by Craya-Curtet number analysis, evidencing predicted in situ air distribution and velocities. As shown in FIG. 2 the plenum chamber may be provided with suitable barriers to define an "air charging zone" within the plenum chamber and enable control over the circumferential portion of the kiln through which the air is permitted to enter the kiln. If desired, a plurality of barriers may be provided so as to enable increasing or decreasing the circumferential length of this air charging zone. For example, the barriers may be in the form of dampers which may be rotated 90° to either pass or block the air flow in the plenum chamber. Alternatively, the barriers may be sliding plates with suitable means on the outside of the plenum for sliding the plate into closed position or open position in the plenum chamber. Thus, by positioning these barriers at predetermined points in the plenum chamber depending upon the carbonaceous material being processed, the kiln and burner characteristics, and the quantities of air desired for various operating parameters and control over the degree of in situ combustion, these barriers may be used in combination to change as desired the circumferential length of the air charging zone and in turn the radial cross-sectional area of the kiln at the burner end over which the air is distributed. It is also possible to make the length of the air charging zone continuously adjustable by providing two barriers, each being slidable around the circumference of the plenum chamber.

In this embodiment the air charging zone in the plenum chamber should surround at least about 120° of the generally upper portion of the kiln. Since the bed of carbonaceous material is normally disposed at some angle from the horizontal because of the rotation of the kiln it is preferable that the barriers defining the air charging zone in the plenum chamber be positioned such that the air charging zone is maintained above the bed of material.

An air charging zone around about 120° of the generally upper circumference of the kiln is suitable for practice of this invention. More preferably, however, the air charging zone will circumvent at least 200° of the kiln.

The present invention finds particular application in the pyrolysis of municipal waste and especially in the process and apparatus described in Bielski et al. U.S. Pat. Nos. 3,862,887 and 3,794,565, respectively (which are hereby incorporated into and made a part of this patent application by reference).

DESCRIPTION OF THE PREFERRED EMBODIMENTS

Figure 1:
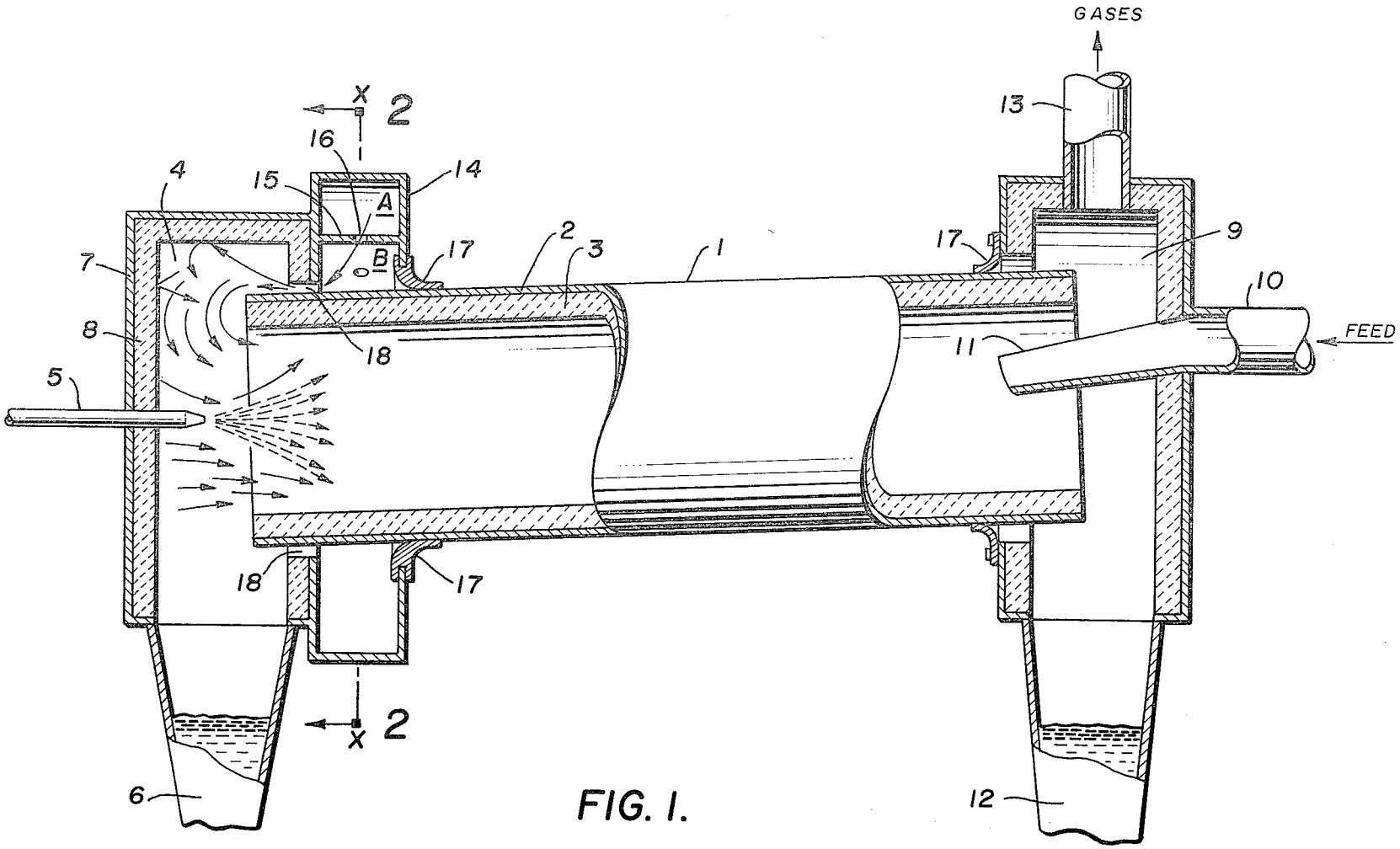
FIG. 1 is a side cross-sectional view of a direct-fired rotary kiln which represents a preferred embodiment of this invention.

FIG. 1 shows a direct-fired ratory kiln 1 comprising a steel outer shell 2 and a refractory lining 3. At one end of the kiln is a burner hood 4 equipped with a burner 5 which is provided to burn supplemental fuel such as gas or oil during start-up and as needed or desired during steady state operation. A solids residue discharge chute 6 may also be conveniently provided in the burner hood with an appropriate seal, e.g., water, against undesired air leaking into the kiln from this source. The burner hood also comprises a steel shell 7 and a refractory lining 8. As will be apparent to those skilled in the art, this is a direct-fired kiln; i.e., a kiln equipped with a burner which projects its flame into a burner hood and/or the kiln itself.

At the opposite end of the kiln is a feed hood 9 equipped with suitable means for charging carbonaceous material to the kiln while excluding undesired air, for example, through a ram feeder 10 onto a chute 11. The feed hood may also be equipped with a spillback chute 12 appropriately provided with a seal, e.g., water, against undesired air leaking into the kiln from this source. A conduit 13 may also be provided in the feed hood for removal of the gaseous materials from the kiln. It will be understood, however, that the feed end of the kiln is no part of the present invention and that the practice of this invention is in no way limited to any particular feed means or system for removal of gases from the kiln.

Disposed circumferentially around the kiln is a plenum chamber 14, one wall of which is in part provided by, or is in metal to metal contact with the steel shell 7 of the burner hood. Plenum chamber 14 is connected by suitable means (not shown) to a source of air or other oxygen-containing gas, for example, by conduit to a fan or blower suitably selected for delivery of the desired quantity of air at desired pressure. The plenum chamber is optionally, but preferably equipped with a partition 15 which divides the plenum chamber, at least through the air charging zone thereof, into two zones A and B, by means of which more uniform distribution of the air into the kiln may be obtained. Partition 15 is provided with one or more openings 16 communicating between zones A and B to permit the flow of air. Opening 16 may be a continuous slot running circumferentially the length of the air charging zone of the plenum chamber. Preferably, however, a plurality of openings 16 are provided in the form of holes or slots in partition 15 throughout the air admitting zone of the plenum chamber, either all in a row or staggered. In this way, air entering zone A becomes more uniformly distributed throughout the air charging zone in the plenum chamber because of the slight impedence to flow into zone B provided by openings 16.

Suitable seals 17 are provided against undesired leakage of air into the kiln. Pyrolysis with in situ combustion of the pyrolysis gases requires good control over the air supplied to the kiln. Air leakage is normally uncontrolled and undesirable. Effective seals which keep leakage down to negligible amounts from a process control standpoint are well-known to those skilled in the art and are not limiting of this invention.

Kiln 1 is supported by suitable trunions and bearings (not shown), one of which is provided with means for rotating the kiln. Supported in this way, an annulus 18 is formed between the outer steel shell 2 of the kiln and the burner 4. Depending upon the size of the kiln and the amount of thermal circumferential expansion of the outer steel shell 2, this annulus 18 may be as large as 2 to 3 inches. In any event it provides ample space for the flow of the air from the plenum chamber 14 into the burner hood 4.

Figure 2:
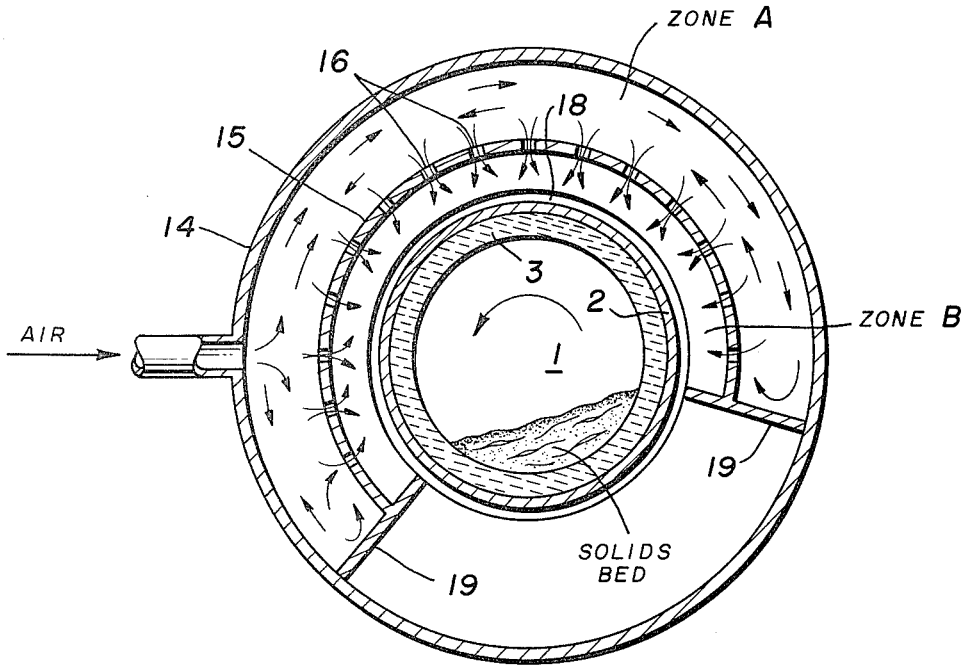
FIG. 2 is a sectional detail taken on line X—X of FIG. 1.

Referring now to FIG. 2 which is a sectional detailed view taken along line X—X of FIG. 1, the internal details of plenum chamber 14 are shown in relation to the kiln 1. The arrows represent a graphic illustration of air flow into zone A and then through openings 16 into zone B. In the embodiment shown, the plenum chamber 14 is provided with two barriers 19 which block off the lower most portion of the plenum chamber 14 and thus define the air charging zone. If desired, the plenum chamber itself can be constructed so as to end at barriers 19 which then become the end walls of the plenum chamber 14, in which event air seal 18 at the underside of the burner end of the kiln is positioned so as to block off annulus 18 on the lower portion of the kiln from where the plenum chamber 14 ends to where it begins again.

Thus, plenum chamber 14 need only be constructed so as to circumvent the kiln 1 for the greatest circumferential distance the process and apparatus are designed for, with suitable barriers 19 within the plenum being provided, if desired, for further limiting or adjusting the circumferential distance of the air charging zone as necessary or desired. The plenum chamber 14 need only extend entirely around the kiln if it is desired, or if process flexibility is desired, to extend the air charging zone around the entire circumference of the kiln.

Figure 3:
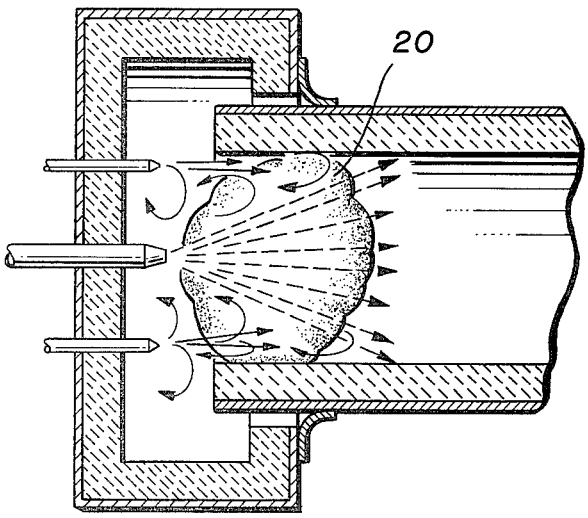
FIG. 3 is a graphic representation of the problem solved by this invention showing the air and burner combustion gas flow when air is admitted to the burner end of a kiln from nozzles as described in the prior art, resulting in an intense fireball in the fire hood or at the nose of the kiln at the burner end. The dashed arrows representing burner combustion gases and the solid arrows representing air.
Figure 4:
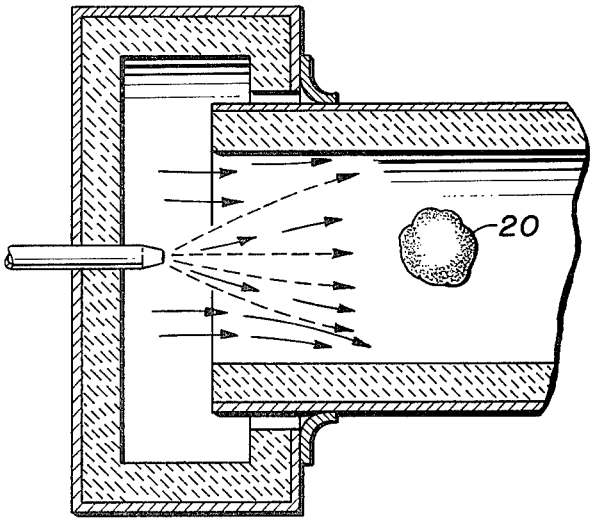
FIG. 4 is a graphic representation of the idealized flow pattern of the air and burner combustion gases in the practice of this invention; the arrows having the same significance as in FIG. 3.

FIGS. 3 and 4 graphically portray the pattern of air and burner combustion gas flow; FIG. 3 portraying the undesirable recirculation of the gases which results in the fireball 20 in or at the burner hood which the present invention avoids; and FIG. 4 portraying an idealized pattern of air and burner combustion gas flow when this invention is practiced which results in a more or less plug flow of gases down the kiln, reducing recirculation of gases and moving the now less intense fireball 20 down the kiln toward the feed end. The solid arrows shown represent burner combustion gases and the dashed arrows represent air; the direction and length of these arrows represent the direction of flow and the relative quantity respectively. The relative size of fireball 20 in each figure is a graphic, but not to any particular scale, representation of the heat intensity of the fireball in each instance, all other parameters being equal. The magnitude of the reduction in heat intensity will depend upon the process parameters employed.

In operation, a fan or other blower (not shown) may be used to blow air into plenum chamber 14 where it is distributed in zone A, passes through openings 16 into zone B and thence through annulus 18 into burner hood 4. The quantity of air, the pressure under which it is delivered and the circumferential distance of the plenum chamber's air charging zone around the kiln are all predetermined as to, first, the process requirements for the desired degree of in situ combustion of the pyrolysis gases insofar as the quantity of in situ air is concerned, second, whether some in situ air is being provided through the burner nozzle, and third, the air velocity and distribution across the radial cross-sectional area of the burner end of the kiln insofar as providing the air pressure and circumferential distance of the air charging zone to obtain the desired Craya-Curtet number is concerned. The parameters may be predetermined for any given process by one skilled in the art once the kiln and burner design and operating characteristics and process requirements have been defined. However, air pressure regulating means (not shown) and barriers 19 are preferably provided so as to allow for precise adjustment and control over these parameters under varying process conditions such as are normally encountered in any plant; for example, changes in feed rate of the kiln, adjustment of the temperature profile in the kiln, changes in quality or pyrolysis characteristics of the carbonaceous material, etc. This latter is a particular problem in processing municipal waste because of its great heterogeneous composition which can vary significantly.

As has already been mentioned, the present invention does not require that burner 14 be in operation at all times. Many pyrolysis processes can be self-supporting through in situ combustion of the requisite proportion of the pyrolysis gases. Even in such instances and particularly if air supply through the burner nozzle is continued, recirculation of air and pyrolysis gases back into the burner hood presents a problem and can result in a fireball in or at the burner hood, a problem which practice of this invention solves.

Figure 5:
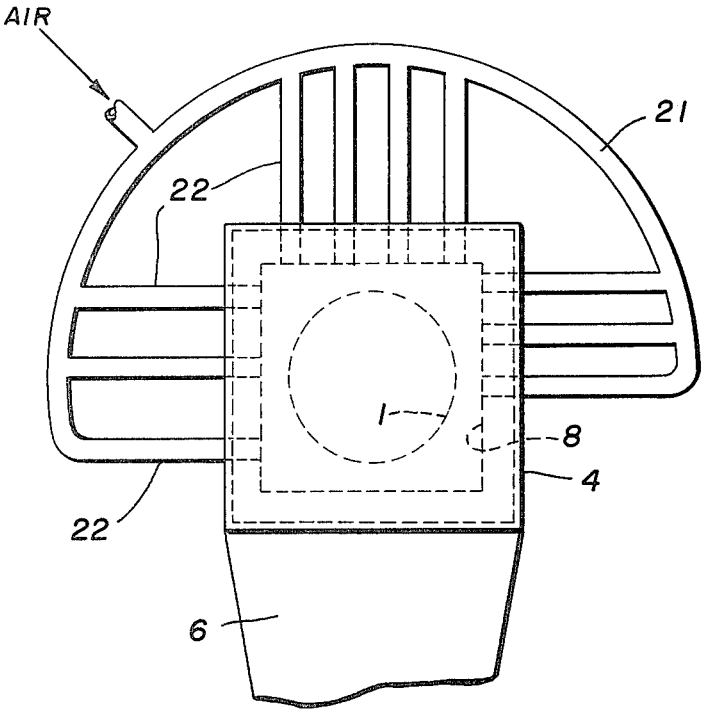
FIG. 5 is an end view of a burner hood, showing the relative position of the rotary kiln and representing another preferred embodiment of this invention.

FIG. 5 shows another preferred embodiment of this invention wherein air is supplied through the refractory lining 8 of the burner hood 4 by means of an air leader pipe 21 and a plurality of conduits 22 communicating from header 21 into burner hood 4. It will be apparent that the greater the number of conduits 22 used the more evenly distributed will be the in situ air within the kiln. However, even though the air is admitted in this embodiment at intermittent points with respect to the circumference of the kiln, results can be obtained which are substantially equivalent to the results obtained in the embodiment using the plenum chamber circumventing the burner end of the kiln, and guidelines discussed with respect to that embodiment as to how far the plenum should circumvent the generally upper portion of the kiln to obtain desired Craya-Curtet numbers will generally apply in this embodiment as to how far the header 21 and conduits 22 should circumvent the burner hood in relation to the kiln.

The foregoing description of the several embodiments of this invention is not intended as limiting of the invention. As will be apparent to those skilled in the art, the inventive concept set forth herein can find many pyrolysis applications in rotary kilns and many variations and modifications to the embodiments described above may be made without departure from the spirit and scope of this invention.

What is claimed is:

1. In a process for pyrolysis of a carbonaceous material in a direct-fired rotary kiln wherein at least a portion of the thermal energy required for pyrolysis is obtained by the in situ combustion of the pyrolysis gases generated within the kiln with controlled quantities of an oxygen-containing gas admitted at the burner end of the kiln, said carbonaceous material undergoing pyrolysis being fed into the kiln at one end of the kiln and flowing toward the burner end of the kiln counter-current to the flow of the gaseous matter in the kiln, the improvement which comprises:

(a) controlling the velocity of any burner combustion gases and the velocity of said oxygen-containing gas within the burner end of the kiln, and (b) distributing said oxygen-containing gas over a sufficiently large proportion of the internal radial cross-sectional area of said burner end of said kiln, so as to obtain a Craya-Curtet number of at least 0.2.

2. A process as in claim 1 wherein the Craya-Curtet number is at least 0.4.

3. A process as in claim 1 wherein the oxygen-containing gas is air.

4. A process as in claim 3 wherein at least a portion of said air is admitted to said burner end of the kiln through an annular space defined between the end of the kiln shell and a burner hood, said annular space extending circumferentially around at least 120° of the kiln proximate the upper portion therof.

5. A process as in claim 4 wherein the Craya-Curtet number is at least 0.4.

6. In a rotary kiln for the pyrolysis of carbonaceous materials comprising a refractory lined rotary kiln, a feed hood proximate one end thereof, a burner hood proximate the opposite end thereof, at least one burner disposed in said burner hood, a gas discharge conduit proximate said feed hood, and means for controllably admitting an oxygen-containing gas proximate said burner hood, whereby carbonaceous material charged to said kiln at said feed hood is caused to undergo pyrolysis and the resulting solid residue is discharged proximate said burner hood, at least a portion of the thermal energy required for pyrolysis being obtained by the in situ combustion of the pyrolysis gases within the kiln with controlled quantities of said oxygen-containing gas admitted to the kiln proximate the burner hood, the pyrolysis gases and the combustion products thereof flowing counter-currently to said heat decomposable organic material, the improvement which comprises:

(a) means for controlling the velocity of any gases from the burner nozzle(s) and the velocity of said oxygen-containing gas within the kiln, and (b) said means for controllably admitting said oxygen-containing gas being such that said oxygen-containing gas is distributed over a sufficiently large proportion of the internal radial cross-sectional end of said burner end of said kiln, so as to provide a Craya-Curtet number of at least 0.2.

7. A rotary kiln as in claim 6 wherein said means for controllably admitting said oxygen-containing gas is such as to provide a Craya-Curtet number of at least 0.4.

8. A rotary kiln as in claim 6 wherein said means for controllably admitting an oxygen-containing gas comprises a plenum chamber circumferentially disposed around the outer shell of said kiln affixed to said burner hood so as to provide communication between said plenum chamber and the annular space defined between the end of the kiln shell and said burner hood circumferentially around at least 120° of the kiln proximate the upper portion thereof, said plenum chamber being further provided with means for admitting air into said plenum chamber.

9. A rotary kiln as in claim 8 wherein means are provided for adjusting the effective circumferential length and location of the air charging zone within the plenum chamber.

10. A rotary kiln as in claim 8 wherein said plenum chamber is partitioned, said partition being disposed within said plenum chamber and extending circumferentially with respect to the kiln so as to divide the plenum chamber into two concentric zones, said partition being provided with at least one opening for the flow of air from the first zone defined by said partition into the second zone defined by said partition.

11. A rotary kiln as in claim 10 wherein means are provided for adjusting the effective circumferential length and location of the air charging zone within the plenum chamber.

* * * * *